US011482367B2

(12) United States Patent
Idogawa

(10) Patent No.: US 11,482,367 B2
(45) Date of Patent: Oct. 25, 2022

(54) IGNITION COIL

(71) Applicant: Mitsubishi Electric Corporation, Tokyo (JP)

(72) Inventor: Takashi Idogawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 509 days.

(21) Appl. No.: 16/328,485

(22) PCT Filed: Sep. 28, 2016

(86) PCT No.: PCT/JP2016/078689
§ 371 (c)(1),
(2) Date: Feb. 26, 2019

(87) PCT Pub. No.: WO2018/061118
PCT Pub. Date: Apr. 5, 2018

(65) Prior Publication Data
US 2019/0214177 A1 Jul. 11, 2019

(51) Int. Cl.
*H01F 27/24* (2006.01)
*H01F 27/02* (2006.01)
(Continued)

(52) U.S. Cl.
CPC ..... *H01F 27/022* (2013.01); *H01F 27/24* (2013.01); *H01F 27/28* (2013.01); *H01F 27/327* (2013.01); *H01F 38/12* (2013.01)

(58) Field of Classification Search
CPC combination set(s) only.
See application file for complete search history.

(56) References Cited

U.S. PATENT DOCUMENTS 4,990,881 A * 2/1991 Ooyabu ..... H01F 3/14 336/110
5,497,756 A * 3/1996 Matthiesen ..... H01F 27/06 123/634
(Continued)

FOREIGN PATENT DOCUMENTS

JP 05-109554 A 4/1993
JP 06-084664 A 3/1994
(Continued)

OTHER PUBLICATIONS

International Search Report of PCT/JP2016/078689 dated Dec. 6, 2016 [PCT/ISA/210].
(Continued)

*Primary Examiner* — Mang Tin Bik Lian
(74) *Attorney, Agent, or Firm* — Sughrue Mion, PLLC; Richard C. Turner

(57) ABSTRACT

An ignition coil, including: a center core; a primary coil wound around the center core; a secondary coil wound around the primary coil; a side core, which is arranged around the secondary coil, and is coupled to the center core to from a closed magnetic path; a case configured to accommodate the center core, the primary coil, the secondary coil, and the side core; and an insulating resin filled in the case, wherein the side core includes a wide portion having a larger width in a direction from the center core to the side core, and a narrow portion having a smaller width than the wide portion, and wherein the narrow portion is formed on a high-voltage side of the side core.

20 Claims, 6 Drawing Sheets

(51) Int. Cl.

| | |
|---|---|
| ***H01F 38/12*** | (2006.01) |
| ***H01F 27/32*** | (2006.01) |
| ***H01F 27/28*** | (2006.01) |

(56) References Cited

U.S. PATENT DOCUMENTS

| | | | | |
|---|---|---|---|---|
| 5,729,505 | A * | 3/1998 | Murata | F02P 3/02 123/634 |
| 5,734,311 | A * | 3/1998 | Murata | H01F 38/12 336/110 |
| 5,764,124 | A * | 6/1998 | Nakamichi | H01F 38/12 336/107 |
| 6,294,973 | B1 * | 9/2001 | Kimura | H01F 38/12 336/107 |
| 7,132,916 | B2 * | 11/2006 | Maekawa | H01F 38/12 336/90 |
| 2002/0007828 | A1 * | 1/2002 | Murata | F02P 3/02 123/647 |
| 2002/0171524 | A1 | 11/2002 | Tsai | |
| 2005/0045166 | A1 * | 3/2005 | Hamada | F02P 3/02 123/634 |
| 2006/0226945 | A1 * | 10/2006 | Maekawa | H01F 38/12 336/90 |
| 2012/0103313 | A1 * | 5/2012 | Idogawa | H01F 38/12 123/634 |

FOREIGN PATENT DOCUMENTS

| | | | |
|---|---|---|---|
| JP | 06084664 | A * | 3/1994 |
| JP | 07-263256 | A | 10/1995 |
| JP | 10275732 | A | 10/1998 |
| JP | 2004-311616 | A | 11/2004 |
| JP | 2006253561 | A | 9/2006 |
| JP | 2009124015 | A | 6/2009 |

OTHER PUBLICATIONS

Communication dated Sep. 14, 2020, from the State Intellectual Property Office of the P.R.C in application No. 201680089390.1.
Communication dated May 14, 2019 from the Japanese Patent Office in counterpart application No. 2018-541781.

* cited by examiner

IGNITION COIL

CROSS REFERENCE TO RELATED APPLICATIONS

This application is a National Stage of International Application No. PCT/JP2016/078689, filed Sep. 28, 2016.

TECHNICAL FIELD

The present invention relates to an ignition coil, which is mounted on, for example, an internal combustion engine, and is configured to supply a high voltage to an ignition plug so as to generate spark discharge.

BACKGROUND ART

In an ignition coil for an internal combustion engine, as disclosed in, for example, Patent Literature 1, a primary coil and a secondary coil are wound around an outer periphery of the center core, and a side core is arranged on an outer side of the coils to form a closed magnetic path. Those components are accommodated in an insulating case made of a resin, and an insulating material such as an epoxy resin is filled in a space inside the case to secure insulation of the components. Further, an elastomer material is coated around the core for reduction of cold heat stress. However, when the entire side core is coated with the elastomer material, dimensions of the ignition coil are increased. In view of this, in the ignition coil disclosed in Patent Literature 1, an outer peripheral surface of the elastomer material being coated on the side core is removed to achieve downsizing of the ignition coil.

CITATION LIST

Patent Literature

[PTL 1] JP 05-109554 A

SUMMARY OF INVENTION

Technical Problem

In recent years, there has been developed a vehicle in which a compression ratio of an internal combustion engine is increased so as to improve fuel efficiency. When the compression ratio is increased, it is required to increase an output voltage of an ignition coil. Then, a voltage corresponding to a voltage generated in the secondary coil is generated in the side core opposed to the secondary coil of the ignition coil. Therefore, as in the ignition coil disclosed in Patent Literature 1, in a case in which an insulating material is not coated around a high-voltage side of the side core, when the output voltage is increased, there is a fear in that electricity is discharged to the ground in the vicinity of the ignition coil.

The present invention has been made to solve the problem described above, and has an object to obtain an ignition coil, which is capable of suppressing electric discharge to the outside without increasing dimensions even when an output voltage is increased.

Solution to Problem

According to one embodiment of the present invention, there is provided an ignition coil, including: a center core; a primary coil wound around the center core; a secondary coil wound around the primary coil; a side core, which is arranged around the secondary coil, and is coupled to the center core to form a closed magnetic path; a case configured to accommodate the center core, the primary coil, the secondary coil, and the side core; and an insulating resin filled in the case, wherein the side core includes a wide portion having a larger width in a direction from the center core to the side core, and a narrow portion having a smaller width than the wide portion, and wherein the narrow portion is formed on a high-voltage side of the side core.

Advantageous Effects of Invention

In the ignition coil according to one embodiment of the present invention, the narrow portion having a width reduced in the direction from the center core to the side core is formed on the high-voltage side of the side core. Thus, it is possible to obtain the ignition coil, which is capable of suppressing electric discharge to the outside without increasing the dimensions even when the output voltage is increased.

DESCRIPTION OF EMBODIMENTS

Now, an ignition coil according to embodiments of the present invention is described with reference to the drawings.

First Embodiment

Figure 1:
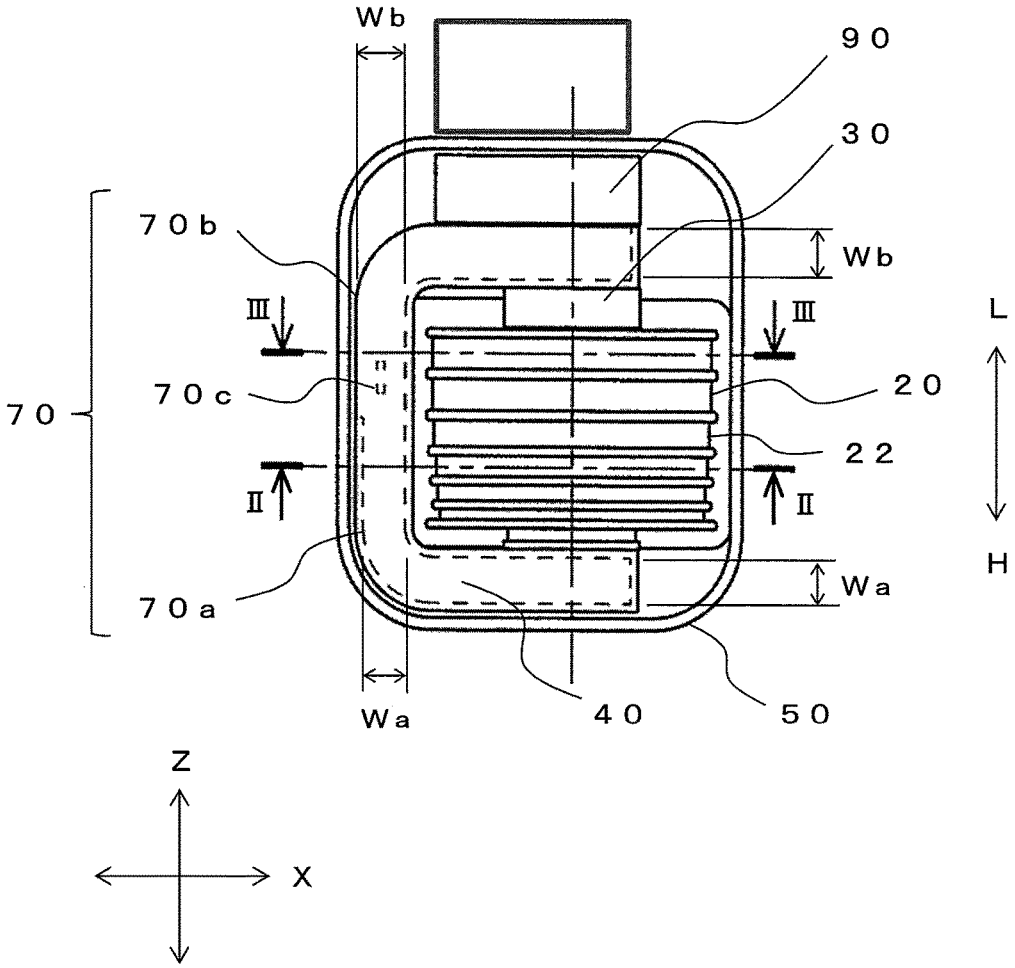
FIG. 1 is a view for illustrating an ignition coil according to a first embodiment of the present invention.
Figure 2:
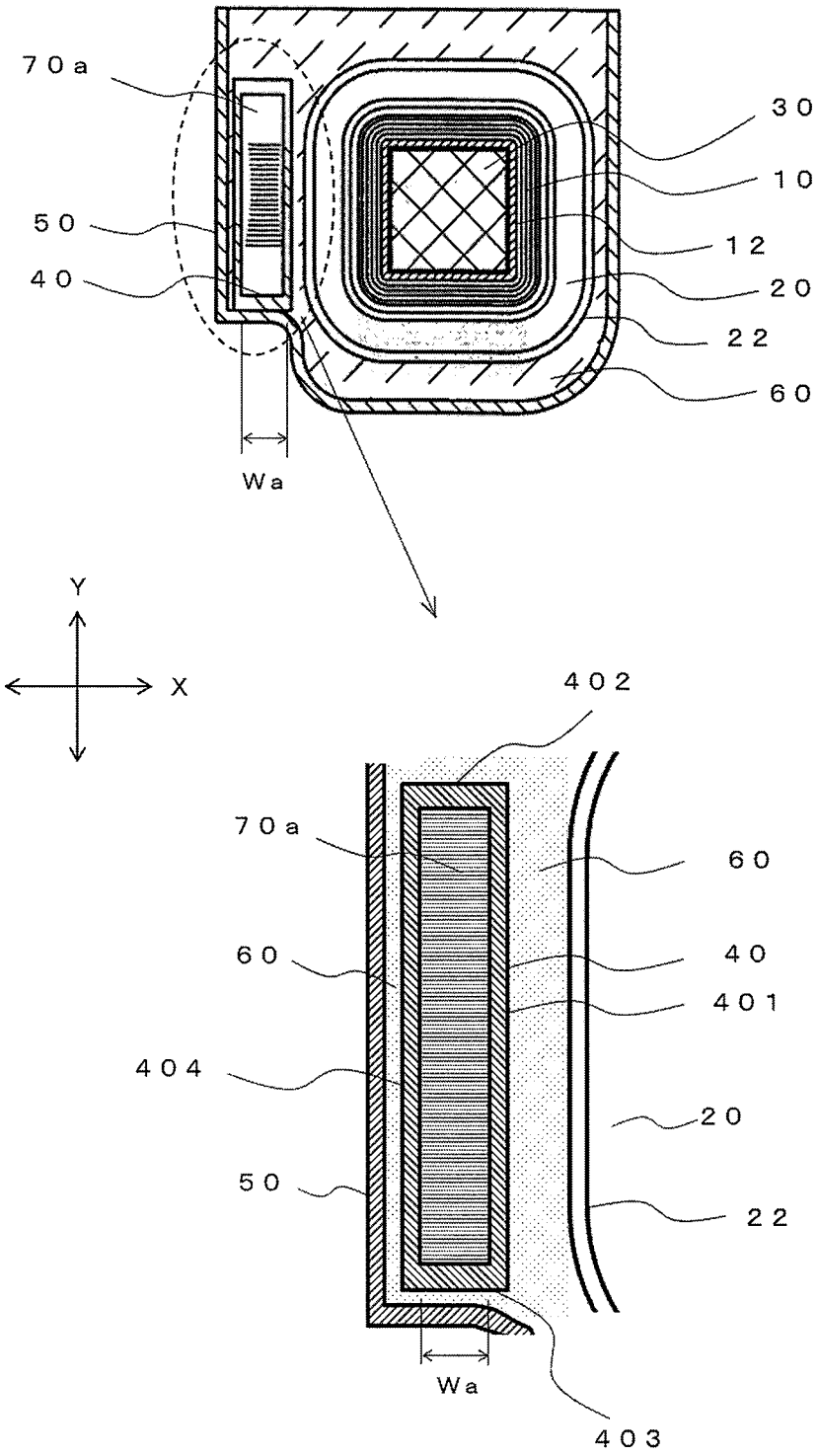
FIG. 2 is a sectional view of the ignition coil illustrated in FIG. 1, which is taken along the line II-II, and a partially enlarged view thereof.
Figure 3:
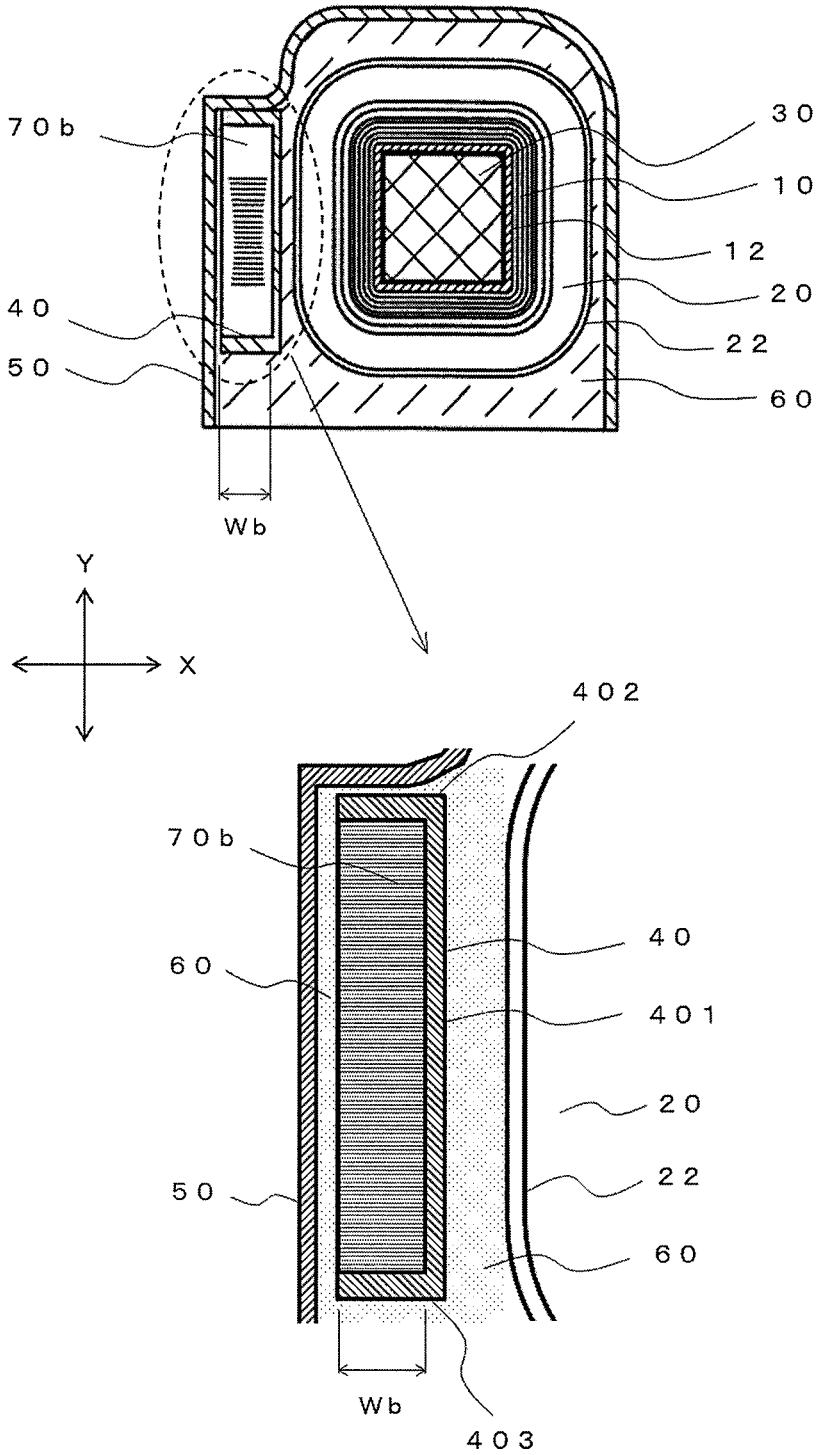
FIG. 3 is a sectional view of the ignition coil illustrated in FIG. 1, which is taken along the line III-III, and a partially enlarged view thereof.

FIG. 1 is a configuration view for illustrating an ignition coil according to a first embodiment of the present invention. FIG. 2 is a sectional view taken along the line II-II in FIG. 1 and a partially enlarged view thereof. FIG. 3 is a sectional view taken along the line III-III in FIG. 1 and a partially enlarged view thereof.

As illustrated in FIG. 1 and FIG. 2, the ignition coil according to the first embodiment includes, in a case 50, a primary coil 10 wound around a bobbin 12 for a primary coil. A bobbin 22 for a secondary coil is provided on an outer side of the primary coil 10, and a secondary coil 20 is wound around the bobbin 22 for a secondary coil with turns, for example, hundred times as many as turns of the primary coil 10. A center core 30 having an I-shape, which is magnetically coupled to the primary coil 10 and the secondary coil 20, passes through the cylindrical bobbin 12 for a primary coil. The center core 30 forms a closed magnetic path with a side core 70 having a C shape that surrounds the primary coil 10 and the secondary coil 20. The ignition coil includes the primary coil 10, the bobbin 12 for a primary coil, the secondary coil 20, the bobbin 22 for a secondary coil, the center core 30, and the side core 70, which are described above. Further, the letters "L" and "H" illustrated with the arrows in FIG. 1 respectively indicate a low-voltage side and a high-voltage side of the ignition coil.

As illustrated in FIG. 1, in the case 50 of the ignition coil, an IC 90 is arranged between an inner wall side surface of the case 50 and the side core 70. As illustrated in FIG. 2 and FIG. 3, an insulating resin 60 being a thermosetting epoxy resin is filled in the case 50 to be cured. In FIG. 1, for easy understanding of a configuration of each of the components arranged inside the case 50, the insulating resin 60 filled in the case 50 is omitted.

In the ignition coil having the above-mentioned configuration, the IC 90 controls supply and interruption of a primary current flowing through the primary coil 10 based on a drive signal from an electronic control unit. When the primary current flowing through the primary coil 10 is interrupted at a predetermined ignition timing of an internal combustion engine based on the drive signal, a back electromotive force is generated in the primary coil 10, and a high voltage is generated in the secondary coil 20. The high voltage thus generated is applied to an ignition plug (not shown) arranged on the high-voltage side in FIG. 1.

FIG. 2 is a sectional view of the high-voltage side of the ignition coil. The side core 70 is formed of a plurality of magnetic steel sheets laminated in a Y direction indicated in FIG. 2. As illustrated in FIG. 2, a narrow portion 70*a* is formed on a high-voltage side of the side core 70 so as to have a width Wa in an X direction orthogonal to a laminating direction.

As illustrated in an enlarged view of FIG. 2, a surface of the narrow portion 70*a*, which is opposed to the secondary coil 20, is covered with a coating 401 formed of an elastomer material 40, and an upper portion and a lower portion of the narrow portion 70*a* in the laminating direction are respectively covered with coatings 402 and 403 formed of the elastomer material 40. A surface of the narrow portion 70*a* on a side opposite to the surface opposed to the secondary coil 20 is covered with a coating 404 formed of the elastomer material 40. The insulating resin 60 is further filled between the case 50 and the side core 70 coated with the elastomer material 40 therearound as described above.

FIG. 3 is a sectional view of the low-voltage side of the ignition coil. As illustrated in FIG. 3, a wide portion 70*b* is formed on a low-voltage side of the side core 70 so as to have a width Wb in the X direction orthogonal to the laminating direction. In this case, a relationship of Wa<Wb is satisfied. Similarly to the narrow portion 70*a*, a surface of the wide portion 70*b*, which is opposite to the secondary coil 20, and an upper portion and a lower portion of the wide portion 70*b* in the laminating direction are respectively covered with the coatings 401, 402, and 403 formed of the elastomer material 40. Unlike the high-voltage side, the coating 404 is not formed on a surface of the wide portion 70*b* on a side opposite to the surface opposed to the surface of the secondary coil 20, and the surface is insulated only with the insulating resin 60. A voltage is low on the low-voltage side, and hence there is no fear in that electricity is discharged to the surroundings even when the coating 404 is not formed.

The side core 70 formed of the laminated steel sheets is caulked at a caulked portion 70*c* in the wide portion 70*b* illustrated in FIG. 1. In this case, the wide portion 70*b* is caulked in order to prevent, by caulking, degradation of performance of the side core 70 due to distortion caused in the magnetic steel sheets.

As described above, in the ignition coil according to the first embodiment, the width of the high-voltage side of the side core 70 is reduced as the narrow portion 70*a*, and the elastomer material 40 is coated around the narrow portion 70*a*. Further, the insulating resin 60 is filled between the elastomer material 40 and the case 50. Therefore, even when a high voltage is induced to the side core 70, electricity is not discharged to the outside. Further, there is no fear in that electricity is discharged to the outside on the low-voltage side of the side core 70. Therefore, the case 50 side is not coated with the elastomer material 40, and is insulated only with the insulating resin 60 filled between the side core 70 and the case 50. Thus, dimensions of the low-voltage side of the ignition coil are not increased.

Second Embodiment

Figure 4:
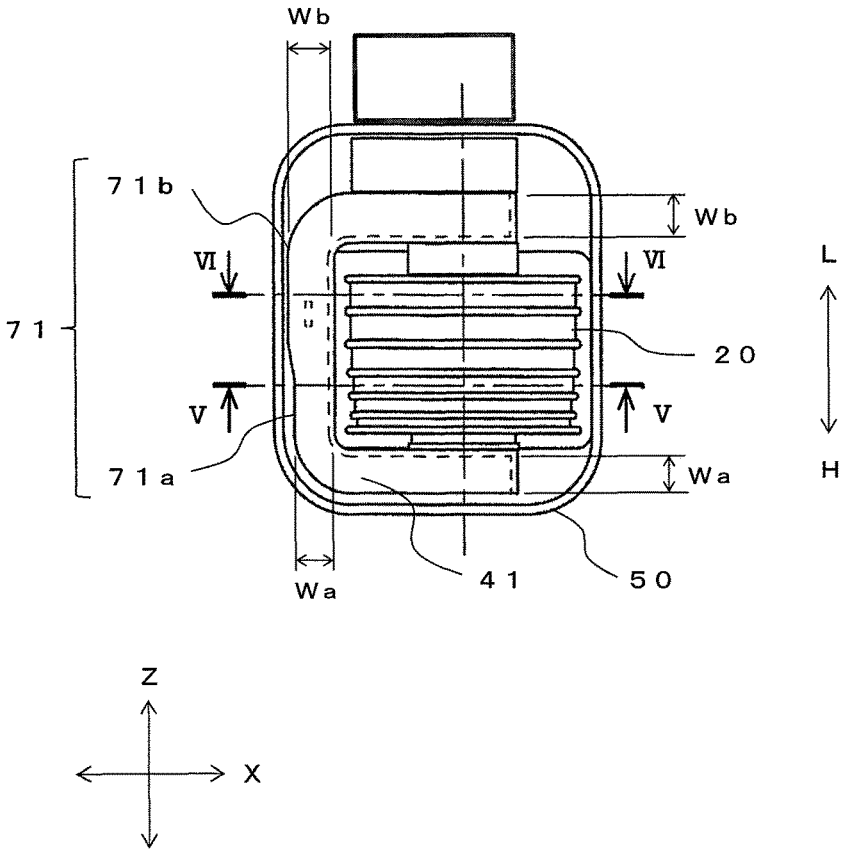
FIG. 4 is a view for illustrating an ignition coil according to a second embodiment of the present invention.
Figure 5:
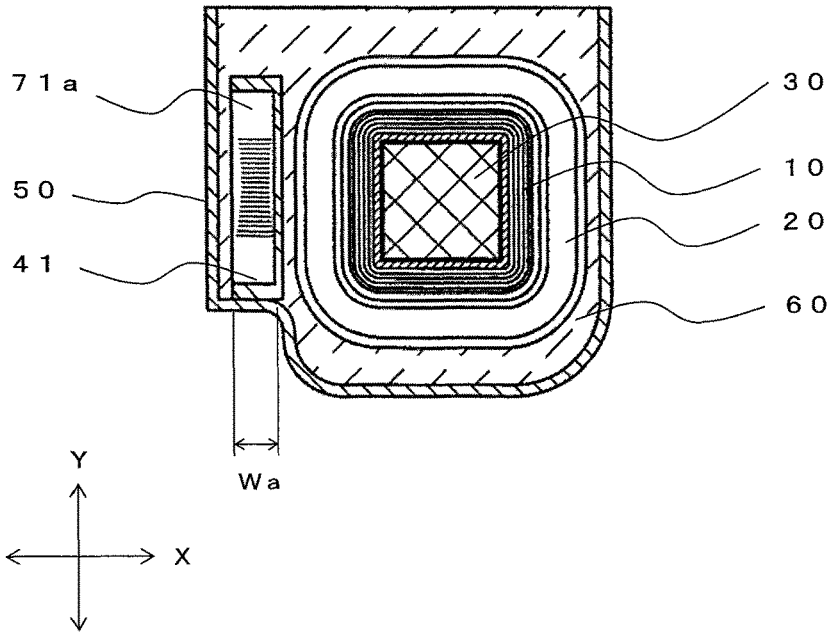
FIG. 5 is a sectional view of the ignition coil illustrated in FIG. 4, which is taken along the line V-V.
Figure 6:
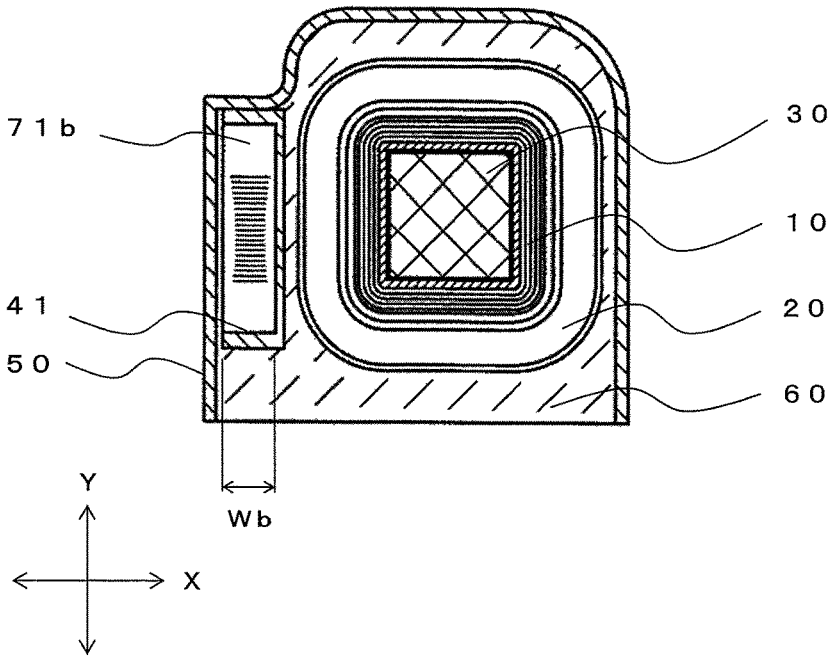
FIG. 6 is a sectional view of the ignition coil illustrated in FIG. 4, which is taken along the line VI-VI.

FIG. 4 is a configuration view for illustrating an ignition coil according to a second embodiment of the present invention. FIG. 5 is a sectional view taken along the line V-V in FIG. 4. FIG. 6 is a sectional view taken along the line VI-VI in FIG. 4. As illustrated in FIG. 4 to FIG. 6, the ignition coil according to the second embodiment has a configuration similar to that of the first embodiment except that shapes of a side core 71 and an elastomer material 41 are different. Similarly to FIG. 1, in FIG. 4, the insulating resin 60 filled in the case 50 is omitted for easy understanding of a configuration of each of the components arranged inside the case 50.

In the second embodiment, a portion between a narrow portion 71*a* and a wide portion 71*b* of the side core 71 is formed so that a width in the X direction is gradually changed as illustrated in FIG. 4. Further, as illustrated in FIG. 5, a portion between the narrow portion 71*a* of the side core 71 and the case 50 is insulated with a thickened layer of the insulating resin 60 in place of being coated with an elastomer material 41.

The elastomer material 41 is a thermoplastic resin, which is molten at high temperature to be brought into a liquid state, and is cured along with reduction in temperature. Therefore, when a coating is to be formed around the side core 71 through use of the elastomer material 41, it is required to pour the elastomer material 41 having been molten at high temperature into a cavity of a mold manufactured in conformity with a shape of the coating, and to cool the elastomer material 41 so as to be cured.

However, flowability of the elastomer material 41 having been molten is poor. Thus, when the shape of the coating is thin, and the cavity of the mold has an insufficient clearance, the elastomer material 41 is less likely to flow to corners of the cavity. Therefore, when a coating of the elastomer material 41 is to be molded around the side core 71, it is required that the coating have a certain thickness or more.

Meanwhile, the insulating resin 60 being an epoxy resin is a thermosetting resin. Flowability of the insulating resin 60 is excellent in a liquid state at normal temperature, and the insulating resin 60 is cured through heating at high temperature. Therefore, the insulating resin 60 can be poured to corners at normal temperature even in a narrow space.

Therefore, when a distance between the case 50 and the side core 71 is short, and hence a clearance is small so that the coating of the elastomer material 41 cannot be thickened, or when the shape of the coating is complicated, an insulating layer can be formed more efficiently by filling the insulating resin 60 having excellent flowability in a clearance than by forming the coating of the elastomer material 41. Further, when an insulating layer is to be formed by filling the insulating resin 60 in the case 50, an insulating layer is formed in accordance with a size of a space in which a resin is filled. Thus, the size of the space in which the resin is filled is set in accordance with a voltage generated in the side core 71 so that an insulating layer having a required thickness can be formed.

As described above, in the ignition coil according to the second embodiment, an insulating layer having a required thickness can be formed between the narrow portion 71*a* and the case 50 through use of the insulating resin 60 without forming a coating of the elastomer material 41 on the narrow portion 71*a* of the side core 70.

Third Embodiment

Figure 7:
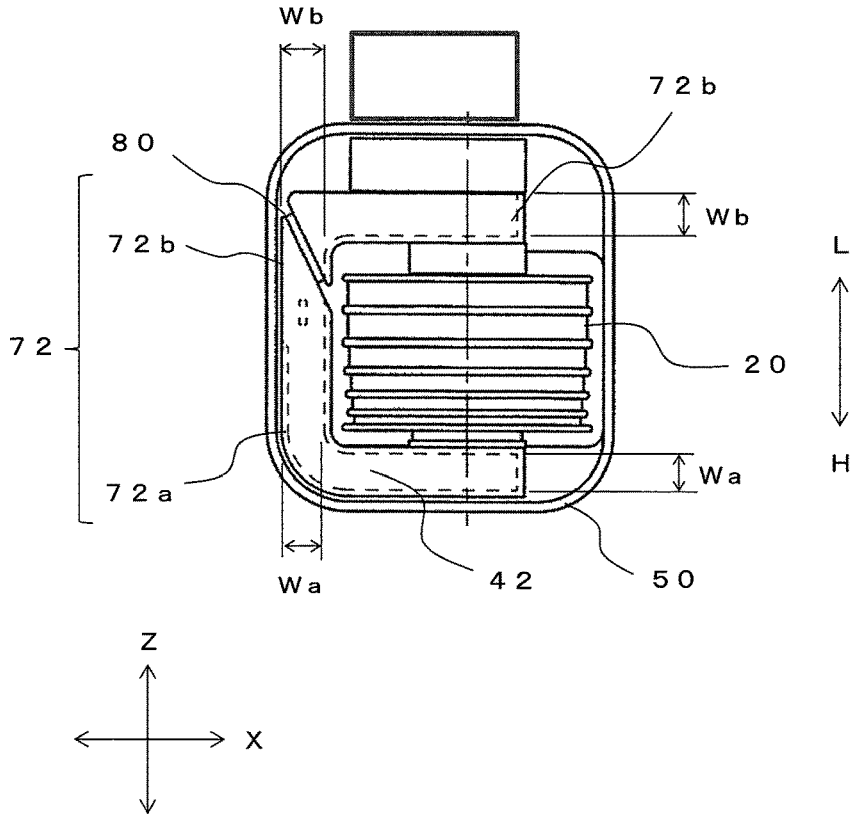
FIG. 7 is a view for illustrating an ignition coil according to a third embodiment of the present invention.

FIG. 7 is a view for illustrating an ignition coil according to a third embodiment of the present invention. As illustrated in FIG. 7, in the third embodiment, a wide portion 72*b* of a side core 72 is divided, and a plate-shaped magnet 80 is inserted between the divided wide portions 72*b* to couple the divided wide portions 72*b*. Further, a sectional area of a narrow portion 72*a* of the side core 72 in an XY plane is set to be 80% or more of a sectional area of the center core 30 in the XY plane. Other configurations are the same as those of the first embodiment. As described above, in the ignition coil according to the third embodiment, output of the ignition coil can be increased through use of the large-sized magnet 80 without increasing the size of the outer shape of the ignition coil.

In the third embodiment, an elastomer material 42 is coated around the narrow portion 72*a* of the side core 72. However, as in the second embodiment, a layer of the insulating resin 60 may be formed between the narrow portion 72*a* and the case 50.

Fourth Embodiment

Figure 8:
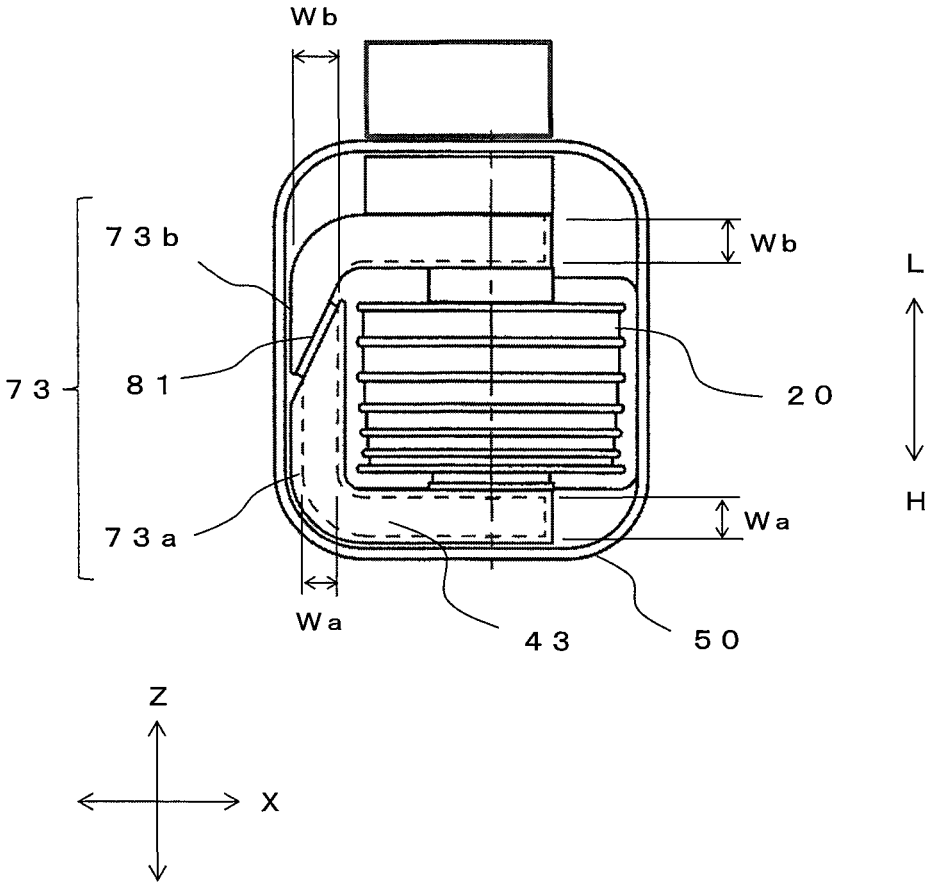
FIG. 8 is a view for illustrating an ignition coil according to a fourth embodiment of the present invention.

FIG. 8 is a view for illustrating an ignition coil according to a fourth embodiment of the present invention. As illustrated in FIG. 8, in the fourth embodiment, a plate-shaped magnet 81 is inserted between a narrow portion 73*a* and a wide portion 73*b* of aside core 73 to couple the narrow portion 73*a* and the wide portion 73*b*. Other configurations are the same as those of the first embodiment.

As illustrated in FIG. 8, in the fourth embodiment, the magnet 81 is inserted obliquely so that a surface thereof on a low-voltage side faces the case 50 side. In FIG. 8, an orientation of a magnetic flux flowing from the center core 30 to the side core 73 is counterclockwise. As illustrated in FIG. 8, the magnet 81 is inserted along the orientation of the magnetic flux so that the magnetic flux flows smoothly.

As described above, in the fourth embodiment, the plate-shaped magnet 81 inserted between the narrow portion 73*a* and the wide portion 73*b* obliquely along the direction of the flow of the magnetic flux, thereby being capable of increasing output of the ignition coil through use of the large-sized magnet 81. Further, the entire front and back surfaces of the large-sized magnet 81 are held in abutment against the cross section of the side core 73 so that a magnetic flux of the magnet 81 can be applied to the side core 73 more efficiently.

In the fourth embodiment, an elastomer material 43 is coated around the narrow portion 73*a* of the side core 73. However, as in the second embodiment, a layer of the insulating resin 60 may be formed between the narrow portion 73*a* and the case 50.

Further, in the first to fourth embodiments, the shapes of the side cores 70 to 73 each have a C shape. However, the shapes of the side cores 70 to 73 are not limited thereto, and, for example, may each have an O shape.

REFERENCE SIGNS LIST

10 primary coil, 12 bobbin for primary coil, 20 secondary coil, 22 bobbin for secondary coil, 30 center core, 40 to 43 elastomer material, 401 to 404 coating, 50 case, 60 insulating resin, 70 to 73 side core, 70*a* to 73*a* narrow portion, 70*b* to 73*b* wide portion, 70*c* caulked portion, 80, 81 magnet, 90 IC

The invention claimed is:

1. An ignition coil, comprising:

a center core;

a primary coil wound around the center core;

a secondary coil wound around the primary coil;

a side core, which is arranged around the secondary coil, and is coupled to the center core to form a closed magnetic path;

a case configured to accommodate the center core, the primary coil, the secondary coil, and the side core; and an insulating resin filled in the case, wherein the side core has a portion facing the secondary coil, a portion connected to the portion facing the secondary coil and the center core on a low-voltage side, and a portion connected to the portion facing the secondary coil and the center core on a high-voltage side, wherein the portion facing the secondary coil includes a wide portion having a first width in a direction perpendicular to the axial direction of the center core, and a narrow portion having a second width that is smaller than the first width in a direction perpendicular to the axial direction of the center core, wherein a width of the portion connected to the portion facing the secondary coil and the center core on the low-voltage side in a direction equal to the axial direction of the center core is the same as the first width, wherein a width of the portion connected to the portion facing the secondary coil and the center core on the high-voltage side in the direction equal to the axial direction of the center core is the same as the second width, wherein the first width is the largest width in the side core, wherein the second width is the smallest width in the side core, wherein the wide portion is located on the low-voltage side of the side core, wherein the narrow portion is located on the high-voltage side of the side core, and wherein a surface of the narrow portion facing the case is closer to a surface of the side core facing the secondary coil than a surface of the wide portion facing the case.

2. The ignition coil according to claim 1, wherein the insulating resin is filled between a surface of the narrow portion, which is opposed to the case, and the case.

3. The ignition coil according to claim 1,
wherein a surface of the side core, which is opposed to the secondary coil, and surfaces on both sides of the side core, which are opposed to the secondary coil are coated with an elastomer material, and
wherein the elastomer material is coated around the narrow portion of the side core.

4. The ignition coil according to claim 1,
wherein the side core is formed of a plurality of laminated magnetic steel sheets, and
wherein the plurality of magnetic steel sheets are firmly fixed by caulking at the wide portion.

5. The ignition coil according to claim 2,
wherein the side core is formed of a plurality of laminated magnetic steel sheets, and
wherein the plurality of magnetic steel sheets are firmly fixed by caulking at the wide portion.

6. The ignition coil according to claim 3,
wherein the side core is formed of a plurality of laminated magnetic steel sheets, and
wherein the plurality of magnetic steel sheets are firmly fixed by caulking at the wide portion.

7. The ignition coil according to claim 1, wherein a sectional area of the narrow portion in a winding direction of the primary coil is 80% or more of a sectional area of the center core in a winding direction of the primary coil.

8. The ignition coil according to claim 2, wherein a sectional area of the narrow portion in a winding direction of the primary coil is 80% or more of a sectional area of the center core in a winding direction of the primary coil.

9. The ignition coil according to claim 3, wherein a sectional area of the narrow portion in a winding direction of the primary coil is 80% or more of a sectional area of the center core in a winding direction of the primary coil.

10. The ignition coil according to claim 4, wherein a sectional area of the narrow portion in a winding direction of the primary coil is 80% or more of a sectional area of the center core in a winding direction of the primary coil.

11. The ignition coil according to claim 1,
wherein the wide portion is divided into a plurality of wide portions, and
wherein the plurality of divided wide portions are coupled to each other through intermediation of a magnet.

12. The ignition coil according to claim 2,
wherein the wide portion is divided into a plurality of wide portions, and
wherein the plurality of divided wide portions are coupled to each other through intermediation of a magnet.

13. The ignition coil according to claim 3,
wherein the wide portion is divided into a plurality of wide portions, and
wherein the plurality of divided wide portions are coupled to each other through intermediation of a magnet.

14. The ignition coil according to claim 4,
wherein the wide portion is divided into a plurality of wide portions, and
wherein the plurality of divided wide portions are coupled to each other through intermediation of a magnet.

15. The ignition coil according to claim 7,
wherein the wide portion is divided into a plurality of wide portions, and
wherein the plurality of divided wide portions are coupled to each other through intermediation of a magnet.

16. The ignition coil according to claim 1,
wherein the side core is divided into the narrow portion and the wide portion,
wherein the narrow portion and the wide portion are coupled to each other through intermediation of a plate-shaped magnet, and
wherein the plate-shaped magnet is arranged to be inclined so that a surface thereof on a low-voltage side faces the case at a portion between the narrow portion and the wide portion.

17. The ignition coil according to claim 2,
wherein the side core is divided into the narrow portion and the wide portion,
wherein the narrow portion and the wide portion are coupled to each other through intermediation of a plate-shaped magnet, and
wherein the plate-shaped magnet is arranged to be inclined so that a surface thereof on a low-voltage side faces the case at a portion between the narrow portion and the wide portion.

18. The ignition coil according to claim 3,
wherein the side core is divided into the narrow portion and the wide portion,
wherein the narrow portion and the wide portion are coupled to each other through intermediation of a plate-shaped magnet, and
wherein the plate-shaped magnet is arranged to be inclined so that a surface thereof on a low-voltage side faces the case at a portion between the narrow portion and the wide portion.

19. The ignition coil according to claim 4,
wherein the side core is divided into the narrow portion and the wide portion,
wherein the narrow portion and the wide portion are coupled to each other through intermediation of a plate-shaped magnet, and
wherein the plate-shaped magnet is arranged to be inclined so that a surface thereof on a low-voltage side faces the case at a portion between the narrow portion and the wide portion.

20. The ignition coil according to claim 7,
wherein the side core is divided into the narrow portion and the wide portion,
wherein the narrow portion and the wide portion are coupled to each other through intermediation of a plate-shaped magnet, and
wherein the plate-shaped magnet is arranged to be inclined so that a surface thereof on a low-voltage side faces the case at a portion between the narrow portion and the wide portion.

* * * * *